US005373970A

United States Patent [19]

Ophardt

[11] Patent Number: 5,373,970

[45] Date of Patent: Dec. 20, 1994

[54] LIQUID SOAP DISPENSER FOR SIMPLIFIED REPLACEMENT OF SOAP RESERVOIR

[75] Inventor: Heiner Ophardt, Vineland, Canada

[73] Assignee: Hygiene-Technik Inc., Beamsville, Canada

[21] Appl. No.: 172,390

[22] Filed: Dec. 23, 1993

[30] Foreign Application Priority Data

Oct. 29, 1993 [CA] Canada ..... 2102016

[51] Int. Cl.[5] ..... B67D 5/06

[52] U.S. Cl. ..... 222/181; 222/321; 222/325

[58] Field of Search ..... 222/181, 183, 321, 325, 222/340, 383

[56] References Cited

U.S. PATENT DOCUMENTS

| | | | |
|---|---|---|---|
| 3,826,408 | 7/1974 | Berndt et al. | 222/181 |
| 4,164,306 | 8/1979 | Perrin | 222/325 X |
| 4,238,056 | 12/1980 | Tucker et al. | 222/325 X |
| 4,345,627 | 8/1982 | Cassia | 222/325 X |
| 4,493,440 | 1/1985 | von Buelow et al. | 222/181 X |
| 4,586,635 | 5/1986 | Collins, Jr. | 222/181 X |
| 4,673,109 | 6/1987 | Cassia | 222/383 X |
| 4,993,600 | 2/1991 | Tucker et al. | 222/181 X |
| 5,165,577 | 11/1992 | Ophardt | 222/181 |
| 5,248,066 | 9/1993 | Olson et al. | 222/181 X |
| 5,282,552 | 2/1994 | Ophardt | 222/325 |

FOREIGN PATENT DOCUMENTS

| | | | |
|---|---|---|---|
| 331376 | 7/1958 | Switzerland | 222/181 |
| 700200 | 11/1953 | United Kingdom | 222/181 |
| 1019718 | 2/1966 | United Kingdom | 222/181 |

*Primary Examiner*—Kevin P. Shaver
*Attorney, Agent, or Firm*—Riches, McKenzie & Herbert

[57] ABSTRACT

A liquid soap dispenser is disclosed having a permanent housing which permits simplified insertion and replacement of disposable fluid reservoirs. The housing includes and actuator assembly which is cycled by a lever between first and second positions. The actuator assembly is configured to couple to a valve assembly on the reservoir so that when cycled, the valve assembly is actuated in sliding movement to dispense a quantity of fluid. The actuator assembly includes a pair of resiliently deformable fingers which act to secure the valve assembly to the actuator assembly for sliding movement therewith. If on insertion of a replacement reservoir, the reservoir is positioned uncoupled from the actuator assembly, on first cycling of the actuator assembly the fingers deform to permit movement of the actuator assembly relative to valve assembly and move towards a coupled orientation. In the coupled orientation, the fingers return to an undeformed configuration securing the valve assembly to the actuator assembly.

21 Claims, 5 Drawing Sheets

8
26
30
62
60
38
34
42
4
43
32
33
72a
40
44
6
64a
54a
46
72b
64b
14
66
10
24
28
17
22
20
16
12
18

LIQUID SOAP DISPENSER FOR SIMPLIFIED REPLACEMENT OF SOAP RESERVOIR

SCOPE OF THE INVENTION

This invention relates generally to fluid dispensers, and more particularly to a liquid soap dispenser which is adapted for simplified replacement of a liquid soap reservoir.

BACKGROUND OF THE INVENTION

Many of todays products sold in liquid form, such as liquid hand soap, are contained in disposable containers or reservoirs which incorporate a pump assembly. Typically the pump assembly includes a reciprocally movable element, which when moved dispenses a quantity of liquid soap from the reservoir. The reservoirs are fitted within a permanent housing which includes a movable actuator assembly which secures and reciprocally moves the movable element to dispense the fluid. This has been found to be both a convenient and economical means of fluid supply and dispensation. As the fluid reservoirs are replaced once the fluid supply is exhausted, it is desirable to manufacture the dispenser and reservoir so as to make replacement of the fluid reservoir as easy and quick as possible.

Known fluid dispensers suffer the disadvantage in that replacement of the fluid reservoir is time consuming, as care must be taken to ensure the reservoir is placed in the permanent housing in the correct dispensing position to dispense fluids. If the reservoir is not placed in the correct dispensing position with the movable element coupled to the actuator assembly, the dispenser will be inoperative as the movement of the actuator assembly will not reciprocally move the movable element and no fluids will be dispensed. To achieve the proper dispensing configuration, the pump assembly must therefore be precisely aligned in the housing to ensure it is properly secured in or coupled to the actuator assembly.

Known fluid dispensers suffer the further disadvantage, in that to secure or couple the pump assembly to the actuator assembly of the housing, an adjustment of the position of the reciprocally movable element is often required. In adjusting the movable element, liquid from the reservoir may be inadvertently dispensed or escape to adhere to and solidify around the permanent housing. These hardened liquids are often difficult to remove, affecting the smooth operation of the dispenser and creating an unfavourable and aesthetically unpleasing appearance.

SUMMARY OF THE INVENTION

To at least partially overcome the disadvantages of known fluid dispensers, the present invention provides a fluid dispenser comprising a housing and a replaceable fluid reservoir, wherein on initial use or cycling of the dispenser, the housing and the fluid reservoir assume an orientation where the reservoir is secured or coupled to the housing in a proper configuration to dispense fluids.

An object of the present invention is to provide an improved fluid dispenser having a housing and a replaceable reservoir which incorporates as part of a fluid dispensing valve, a movable element. The housing includes a movable actuator assembly for coupling to the movable element. When the actuator assembly and movable element are coupled, the movement of the actuator assembly moves the movable element to dispense fluid from the reservoir. The actuator assembly is configured such that if the reservoir is inserted into the housing in a position uncoupled from the actuator assembly, the first activation of the dispenser moves the actuator assembly relative to the movable element to a position where the movable element and actuator assembly are secured together in a coupled orientation.

Another object of the invention is to provide a dispenser which will permit insertion of a replaceable reservoir therein regardless of the initial position of the movable element.

A further object is to provide an improved dispenser for the dispensation of liquid soap.

The present invention provides a fluid dispenser which includes a replaceable reservoir and a permanent housing. The housing is configured to support the reservoir in a dispensing position. The reservoir includes a chamber for holding fluids and a portioning valve which includes a reciprocally movable element, the movement of which dispenses predetermined amount of fluid outwardly from the chamber. The housing includes an actuator assembly movable between first and second positions. The actuator assembly is adapted for coupling to the reciprocally movable element, wherein in a coupled orientation the movement of the actuator assembly moves the movable element to dispense fluid. The actuator assembly is further configured such that if the reservoir is inserted into the housing with the reciprocally movable element uncoupled, so that the movable element and actuator assembly may move independently, on first cycling of the actuator assembly, the actuator assembly is moved relative to the reciprocally movable element to secure it thereto. By cycling of the actuator assembly it is generally meant the movement of the actuator assembly from the first position to the second position and back to the first position during the normal operation of the dispenser.

The dispenser of the present invention advantageously permits quicker replacement of the reservoir, as it is not required to precisely align the reciprocally movable element with the actuator assembly to ensure the reservoir is inserted into the housing with the movable element and actuator assembly in a coupled orientation. Additionally, as there is no longer the need to adjust the position of the reciprocally movable element on the insertion of the reservoir, the disadvantages of inoperative arrangement and/or premature dispensation or escape of fluids from the chamber are eliminated.

Preferably one of the actuator assembly and the reciprocally movable element includes a catch assembly. The catch assembly is configured to permit movement of the actuator assembly relative to the reciprocally movable element from a position where the actuator assembly and reciprocally movable element are in an uncoupled orientation, to a position where the actuator assembly and reciprocally movable element are in a coupled orientation. Once in the coupled orientation, the catch assembly prevents movement of the actuator assembly relative to the movable element to return to the uncoupled orientation.

Preferably the reciprocally movable member is a piston which, on insertion of the reservoir into the housing, is substantially positioned in a cavity formed in the actuator assembly. The piston includes an engagement flange, which on insertion of the reservoir, either locates fully within a first zone of the cavity, wherein the piston and actuator assembly are in the coupled orientation, or the engagement flange locates at least partially in a zone of the cavity other than the first zone, wherein the piston and actuator assembly are in the uncoupled orientation. When the engagement flange is located at least partially in the zone other than the first zone, the first cycling of the actuator assembly moves the actuator assembly relative to the piston until the engagement flange is positioned fully within the first zone.

The catch assembly preferably forms part of the actuator assembly and includes one or more fingers. Each finger carries at a first end a tab. The first end of the fingers are resiliently deformable from an unbiased position to a biased position. In the unbiased position, the tabs are positioned to engage and retain the engagement flange of the piston when it is fully in the first zone, substantially preventing its withdrawal therefrom. In the biased position, the tabs are moved out of contact with the piston sufficiently to permit movement of the actuator assembly relative to the piston.

When the engagement flange is positioned fully in the first zone, the fingers assume the unbiased position, with the tabs engaging the engagement flange to couple it to the catch assembly. When the engagement flange is positioned at least partially in the zone other than in the first zone, and the piston and actuator assembly are uncoupled, the first cycling of the actuator assembly moves the fingers to the biased position and the catch assembly is moved relative to the piston so that the engagement flange is relocated fully in the first zone. On the relocation of the engagement flange fully in the first zone, the resiliency of the fingers causes their return to the unbiased position, coupling the piston to the actuator assembly. More preferably, the cavity in which the engagement flange locates comprises a slot having a lateral dimension defined by two or more of the fingers.

The reservoir is inserted into the housing by sliding the piston radially inward into the slot in a direction transverse to the direction of axial movement of the catch assembly. When the reservoir is fully inserted, the piston is positioned between the fingers, axially aligned in the slot. The movement of the actuator assembly causes the axial reciprocal movement of the catch assembly together with the piston to dispense fluid.

Preferably each tab projects angularly from its associated finger such that a leading surface of each tab forms a camming surface. With the piston and actuator assembly in an uncoupled orientation, the first cycling of the dispenser moves the leading surfaces into contact with the piston to assist in moving the fingers to the biased position. When the engagement flange is fully within the first zone and the fingers return to the unbiased position, a trailing edge or surface of the tabs engages the engagement flange to couple the piston to the actuator assembly. By a leading surface, it is generally meant, the surface of the tab which forms an obtuse angle with the remainder of the finger. By a trailing edge or surface, it is generally meant the surface of the tab opposite the leading surface or the edge portion of the tab therebetween.

Accordingly in one of its aspects the present invention resides in a dispenser for dispensing fluid comprising, a housing, a reservoir, the housing supporting the reservoir in a dispensing position, the reservoir being insertable into said housing to assume said dispensing position and removable therefrom for replacement, the reservoir comprising, (i) a chamber for retaining fluid having an outlet, and (ii) valve means disposed across the outlet for dispensing fluid from the chamber, the valve means comprising a reciprocally movable element for reciprocal movement relative to the housing when the reservoir is in the dispensing position to dispense fluid, the reciprocally movable element including engagement means, the housing including actuator means movable relative the housing between a first position and a second position, the actuator means including catch means, the actuator means further having a cavity to receive the engagement means therein when the reservoir is in the dispensing position, the cavity having a first zone and a second zone, wherein on insertion of the reservoir into the housing into the dispensing position, the engagement means is located in the cavity disposed in one of: (1) a first orientation with the engagement means fully in the first zone, (2) a second orientation with the engagement means partially in the first zone and partially in the second zone, and (3) a third orientation with the engagement means fully in the second zone; such that (a) when the engagement means is in one of the second orientation and the third orientation, on first cycling of the actuator means between the first position and the second position, the actuator means moves relative to the engagement means to assume the first orientation in which the engagement means is fully in the first zone, and (b) whenever the engagement means is in the first orientation, the catch means retains the engagement means in the first zone against movement to the second zone, thereby coupling the engagement means to the actuator means for reciprocal movement of the engagement means to dispense liquid with movement of the actuator means between the first position and the second position.

In another aspect the present invention resides in a dispenser for dispensing fluid comprising, a housing, a reservoir, the housing supporting the reservoir in a dispensing position, the reservoir being insertable into said housing to assume said dispensing position and removable therefrom for replacement, the reservoir comprising, (i) a chamber for retaining fluid having an outlet, and (ii) valve means disposed across the outlet for dispensing fluid from the chamber, the valve means comprising a reciprocally movable element for reciprocal movement relative to the housing when the reservoir is in the dispensing position to dispense fluid, the reciprocally movable element including engagement means, the housing including actuator means movable relative a remainder of the housing between a first position and a second position, the actuator means including catch means to engage the engagement means a couple the reciprocally movable element to the actuator means, wherein when the reservoir is inserted into the dispensing position, the engagement means and catch means assume relative positions selected from; (a) a coupled orientation in which the catch means engages the engagement means for reciprocal movement of the element to dispense fluid with movement of the actuator means between the first position and the second position, and (b) an uncoupled orientation from which on a first cycling of the actuator means between the first position and the second position, the catch means and engagement means are moved relative to each other that they assume the coupled orientation.

BRIEF DESCRIPTION OF THE DRAWINGS

Further objects and advantages of the invention will appear from the following description taken together with the accompanying drawings in which.

DETAILED DESCRIPTION OF THE DRAWINGS

Figure 1:
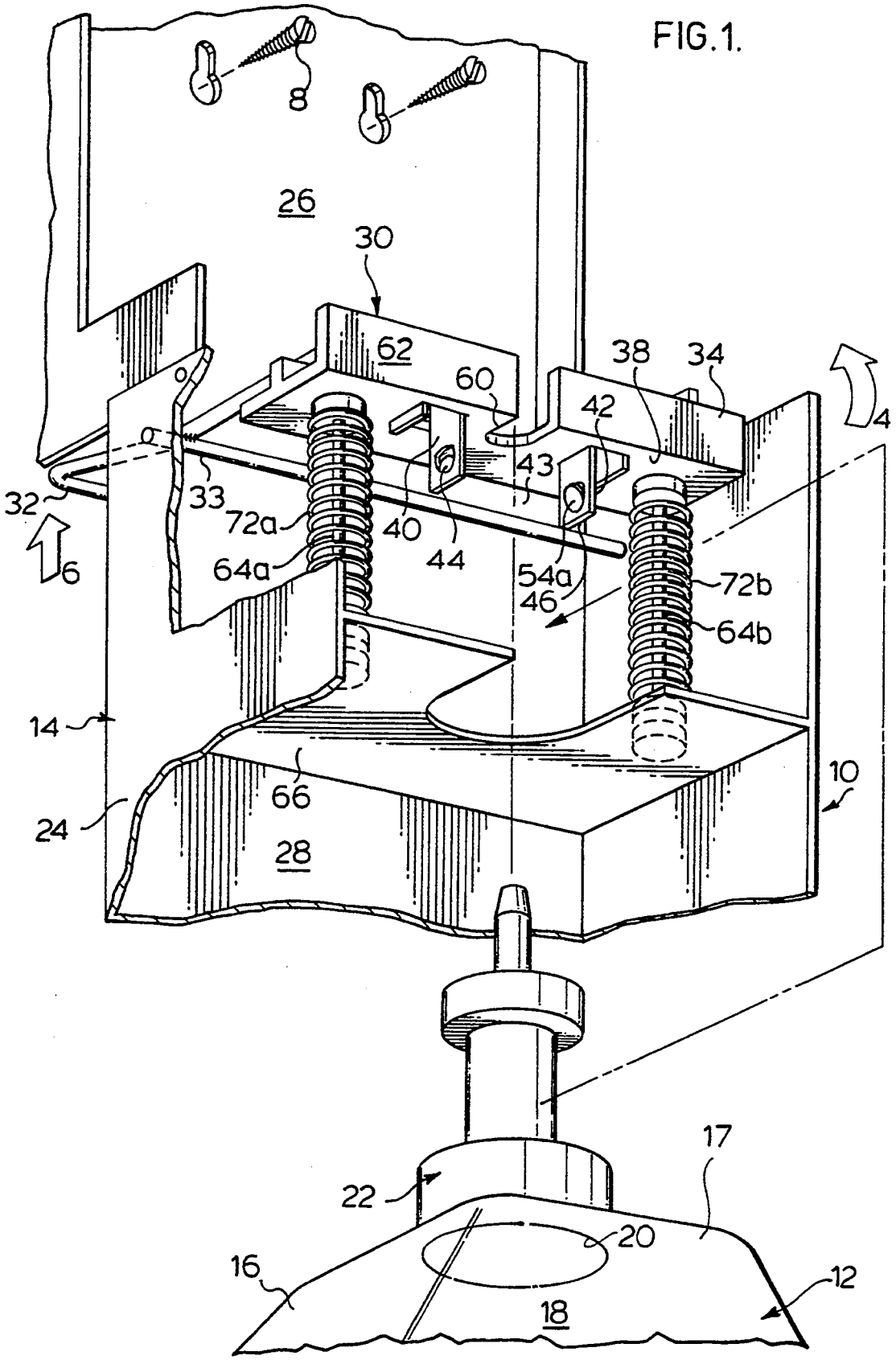
FIG. 1 is an exploded partial perspective view of a preferred embodiment of a housing and reservoir in accordance with the invention with the housing open for reservoir insertion.

Reference is made first to FIG. 1 which shows a dispenser 10 in accordance with a preferred embodiment of the invention. The dispenser 10 comprises a reservoir 12, and a housing 14.

The reservoir 12 comprises a chamber 16 for holding fluid 18, as for example liquid soap, which is to be dispensed. An outlet 20 is provided through a lower most wall 17 of the chamber 16, across which is located a valve assembly 22 to regulate the flow of fluid 18 outwardly therethrough. Preferably the reservoir 12 is made entirely of plastic and is disposable once the supply of fluid 18 is exhausted.

FIG. 1 shows the housing 14 in an open configuration, ready for insertion of the reservoir 12. The housing 14 includes a cover 24 which is hingely connected to a backplate 26 adapted for permanent attachment to a wall by screws 8 or other known means. The cover 24 pivots relative to the back plate 26 about hinge pivot 25 in a known manner from the open position, which permits removal and replacement of the reservoir 12, in the direction of arrow 4 to a closed position, wherein the dispenser may be used to dispense fluid 18. With the cover 24 open to the piston shown in FIG. 1, the reservoir 12 is inserted into the housing 14 with the outlet 20 oriented upwardly. The movement of the cover 24 to the closed position inverts the reservoir 12 so that the outlet 20 is reoriented downwards ready to dispense fluid 18.

The cover 24 is formed having a generally box-like shape so as to define a reservoir cavity 28 in which the reservoir 12 is housed. With the reservoir 12 inserted in the cavity 28, the cover 24 is closed to move the reservoir 12 to a dispensing position wherein the fluid 18 may be dispensed outwardly via the opening 20 and valve assembly 22. An actuator assembly 30 is provided in the housing 14, movable relative to the cover 24 to activate a movable piston element 78 of the valve assembly 22, and effect fluid 18 dispensation.

The present invention is focused on the actuator assembly 30, which includes generally a lever 32 which is pivotally connected to the cover 24, and a catch assembly 34 for engaging and securing part of the piston element 78 thereto. The lever 32 includes, and pivots in the direction of arrow 6 about the axis of, a metal rod 33 which extends across the cover 24. One end of the lever 32 abuttingly contacts the catch assembly 34 such that pivotal movement of the lever 32 moves the catch assembly 34 between a first rest position spaced from the reservoir 12, and a second fully inserted position wherein the catch assembly 34 is moved thereto.

Figure 2:
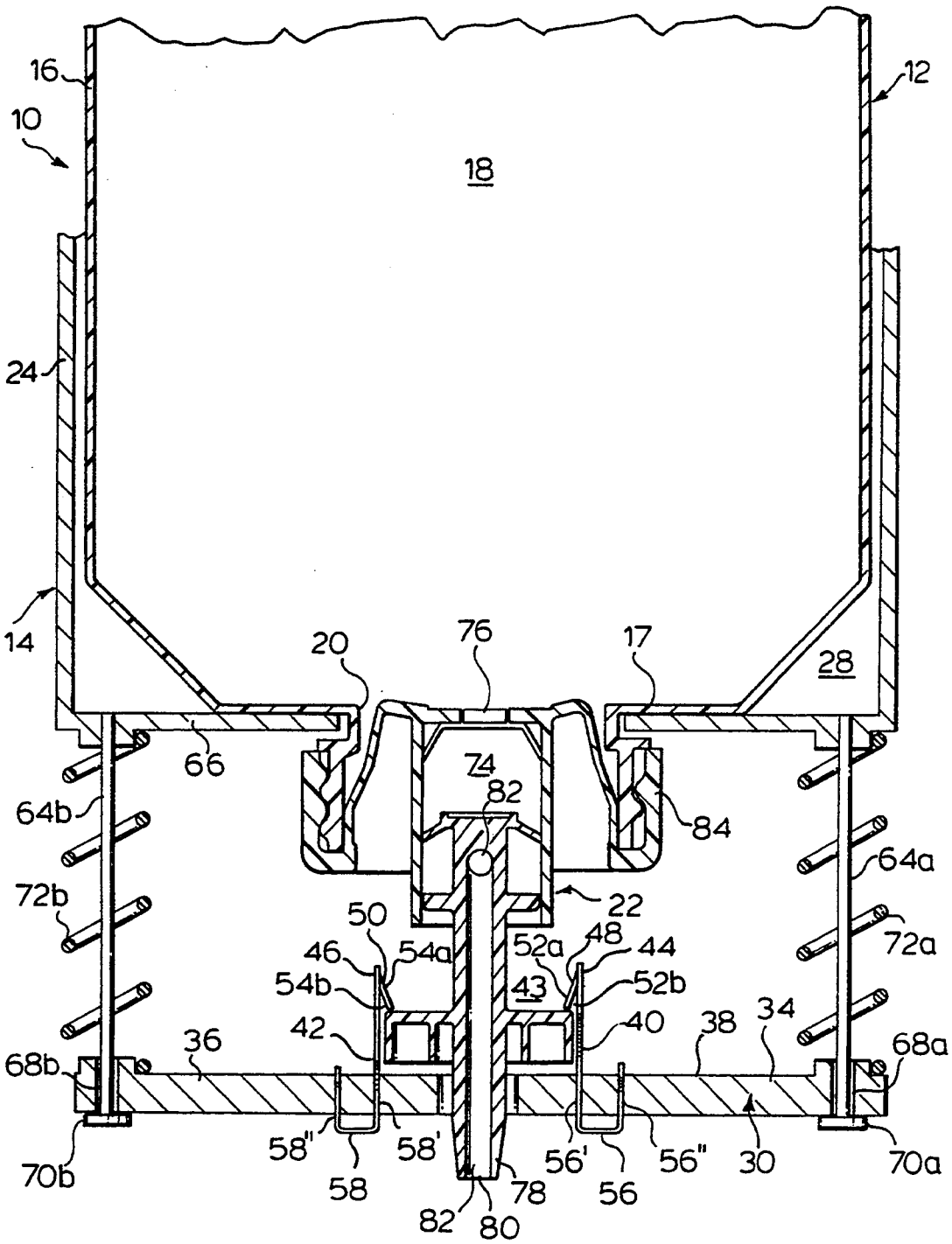
FIG. 2 is a partial cross sectional view of the preferred embodiment of the housing and reservoir of FIG. 1 in a coupled first orientation with the actuator assembly and the reciprocally movable piston element in a first fully extended rest position.

As will be described in greater detail hereafter, the actuator assembly 30 permits the sliding insertion of the reciprocally movable piston element 78 into the catch assembly 34 either into an orientation where the catch assembly 34 and piston element 78 are coupled for movement together, as shown in FIG. 2, or an uncoupled orientation where the catch assembly 34 may move independently from the piston element 78, shown in FIGS. 4 and 5.

In the coupled orientation, the pivotal movement of the lever 32 axially moves the catch assembly 34 and piston element 78 between the first rest and second fully retracted positions, to dispense a quantity of fluid 18. If the reservoir 12 is inserted with the piston element 78 in the uncoupled orientation of FIGS. 4 and 5, in a manner later described, the first movement of the lever 32 moves the catch assembly 34 relative to the piston element 78 until the catch assembly 34 engages the piston element 78 and assumes the coupled orientation of FIG. 2. In this manner the dispenser 10 is operative to dispense fluid 18 regardless of whether the piston element 78 is initially inserted into the housing 14 either coupled or uncoupled to the catch assembly 34.

As best seen in FIG. 1, the catch assembly 34 includes a shoulder member 36 having a tabular surface 38 which is oriented uppermost towards the chamber 16 when the reservoir 12 is inserted and the cover 24 is closed. A pair of substantially parallel spaced metal fingers 40,42 extend from the tabular surface 38 towards the chamber 16, the fingers 40,42 substantially defining the lateral extent of a cavity or slot 43 therebetween. Each finger 40,42 comprises a flattened ribbon of metal, formed so that a first endmost portion 44,46 of each respective finger 40,42 which is remote from the shoulder member 36 is resiliently deformable from an unbiased position, wherein the fingers 40,42 assume their substantially parallel configuration, to a biased position, wherein the endmost portions 44,46 are moved apart.

As shown in FIG. 2, finger endmost portion 44 includes an integrally formed projecting tab 48, with finger endmost portion 46 including integrally formed projecting tab 50. The tabs 48,50 are generally located along each respective finger 40,42, an equal distance from the tabular surface 38. Each of the tabs 48,50 projects inwardly into the slot 43 towards the other, extending angularly downward from the associated fingers 40,42 towards the tabular surface 38. In this manner tab 48 extends from endmost portion 44, so as to define thereon a leading side 52*a* which forms an obtuse angle with a remainder of the finger 40, and a trailing lowermost edge 52*b*. Similarly, tab 50 extends from endmost portion 46, so as to define thereon a leading side 54*a* which forms an obtuse angle with a remainder of finger 42, and trailing lowermost edge 54*b*.

In the embodiment shown, a second endmost portion 56,58 of each respective finger 40,42 is secured to the shoulder member 36, as for example, by snap fitting in complimentary slots 56', 56" and 58', 58" formed therethrough. A generally U-shaped fluid passage 60 is formed through the shoulder member 36 between second endmost portions 56 and 58. As shown in FIG. 1, the fluid passage 60 extends from a side 62 of shoulder member 36, a distance into the tabular surface 38.

A generally U-shaped web 66 is provided extending across the cavity 28. The U-shaped web 66 is positioned to permit the reservoir 12 to be slid radially inward into the housing 14, in the manner illustrated in FIG. 1. The web 66 is located such that when the reservoir 12 is slid into the housing 14 and the cover 24 is closed, the web 66 abuts and supports the lower most wall 17 fluid chamber 16 to assist in maintaining the reservoir 12 in fluid dispensing position. Web 66 also engages part of the valve assembly 22 such that the web 66 is sandwiched between the wall 17 and the valve assembly, thereby preventing axial sliding movement of the reservoir 12 as the dispenser 10 is used. The U-shape of the web 66 further advantageously assists in guiding the reservoir 12 as it is inserted into and removed from the housing 14.

Two parallel spaced locating rods **64*a*,64*b* are secured at a first end to the web 66. At a second end, each locating rod 64*a*,64*b* extends through respective openings 68*a*, 68*b* formed through the shoulder member 36. A retaining ferrule 70*a*,70*b* secured about the second end of each rod 64*a*,64*b* respectively prevents the complete withdrawal of the locating rods 64*a*,64*b* from the shoulder member 36. In this manner, the catch assembly 34 is guided in sliding movement along the rods 64*a*,64*b*, between the first rest position shown in FIG. 2, wherein the shoulder member 38 abuts against ferrules 70*a*,70*b*, and the second fully inserted position wherein the shoulder member 36 and fingers 40,42 are moved along rods 64*a*,64*b* a distance towards the web 66**.

Springs **72*a*,72*b* are provided about each of the locating rods 64*a*,64*b* respectively. The springs 72*a*,72*b* are sized to engage both the web 66 and the shoulder member 36, to resiliently bias the catch assembly 34 to the first position. As is to be appreciated, pivotal movement of the lever 32 in the direction of the arrow 6 shown in FIG. 1 moves the end portion thereof against the shoulder member 36 to overcome the force of the springs 72*a*,72*b*, moving the catch assembly 34 from the first rest position to the second retracted position. On release of the lever 32, the force of the springs 72*a*,72*b* returns the catch assembly 34** to the first rest position.

Figure 3:
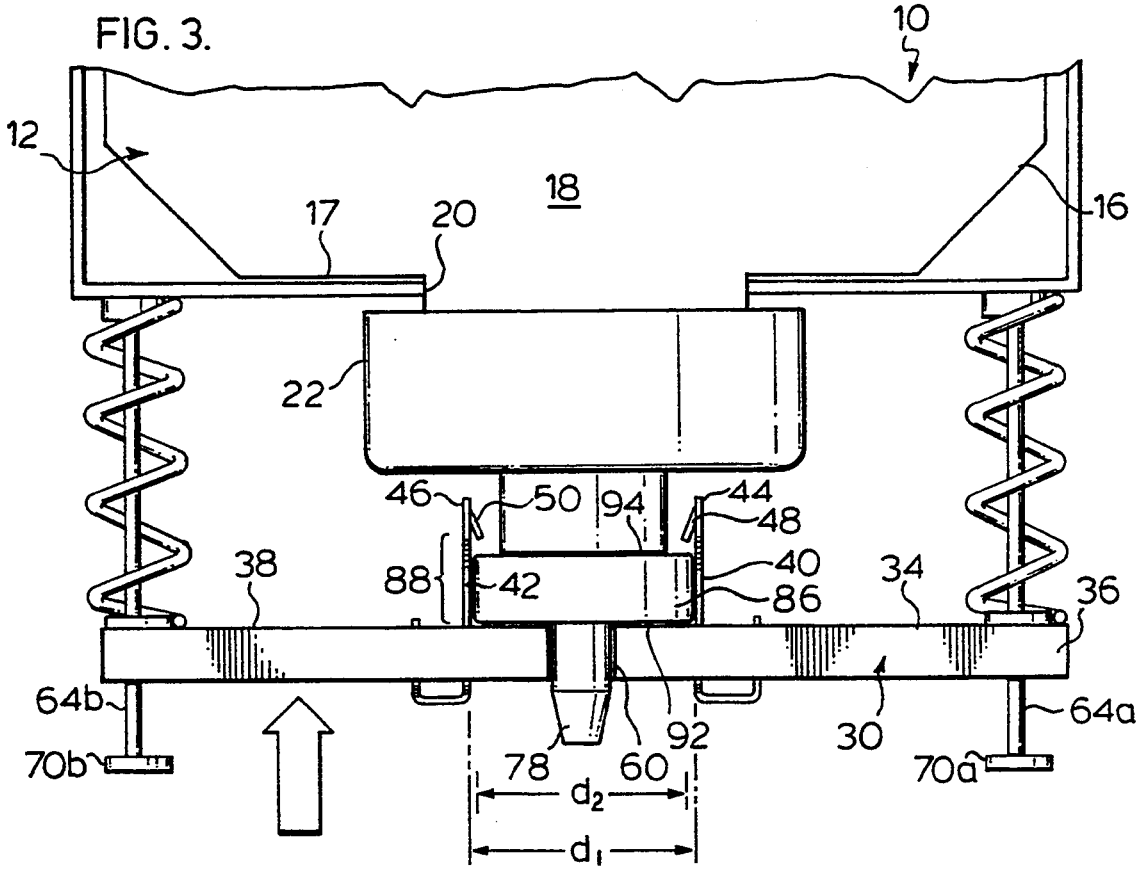
FIG. 3 is a partial perspective view of the reservoir and housing of FIG. 1 in a coupled first orientation with the activator assembly and piston element moved to a second fully retracted position.

FIGS. 2 and 3 show the reservoir valve assembly 22 as comprising a dispensing chamber 74 having at an inward most end thereof, a one-way valve 76 which permits fluid 18 to flow outwardly only from the chamber 16 into the dispensing chamber 74. The reciprocally movable piston element 78 is slidably received within the dispensing chamber 74. The reciprocal movement of the piston element 78 causes fluid 18 to flow from the chamber 16 outwardly past the one-way valve 76 and out an outermost end 80 of the piston element 78 via a passage 82 formed therein. A generally circular radially extending flange 86 adjacent the outermost end 80 provides an engagement surface by which the piston element 78 may be actuated in reciprocal sliding movement to dispense fluid 18.

The radial dimension of the radially extending flange 86 is selected to permit its complimentary fitted placement in the slot 43 between the fingers 40 and 42. As seen best in FIG. 3, the radial diameter of the flange 86 is preferably selected equal to or marginally smaller than the outermost distance $d_1$ between unbiased fingers 40 and 42 and greater than the inner most distance $d_2$ between tab 48 and tab 50. The radially extending flange 86 preferably has an axial extent marginally smaller than the shortest distance between tabs 48,50 and the tabular surface 38, so as to permit its fitted placement therebetween. The radially extending flange 86 is sized having a radial dimension larger than the remainder of the piston element 78 so as to engage an endmost surface 75 of the dispensing chamber 74 to limit its inward sliding movement therein.

In a manner to be described in greater detail hereafter, the actuator assembly 30 is reciprocally movable relative to the reservoir 12 so as to engage and reciprocally slide the piston element 78 to dispense fluid 18.

On insertion and replacement of the reservoir 12, the cover 24 is moved to the open position shown in FIG. 1. The reservoir 12 is aligned in the reservoir cavity 28 with the outlet 20 positioned towards the actuator assembly 30, and the piston element 78 axially aligned with slot 43. The reservoir 12 is slid into the housing 14 such that the lower wall 17 is positioned abutting the U-shaped web 66, with the web 66 sandwiched between part of the lower wall 17 and a threaded rim 84 of the valve assembly 22. As the reservoir 12 is inserted, the radially extending flange 86 slides radially into position intermediate the fingers 40,42, and the outermost end 80 of the piston element 78 moves into the U-shaped fluid passage 60.

Figure 4:
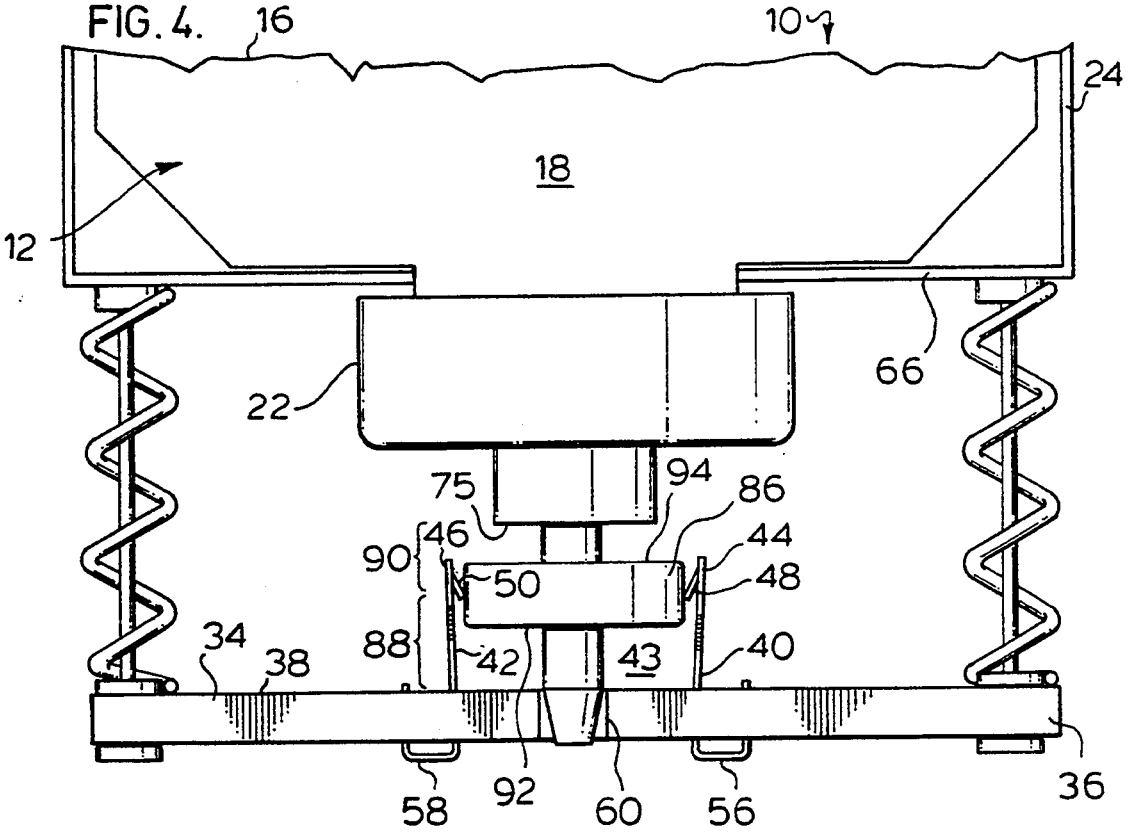
FIGS. 4 and 5 show partial perspective views of the identical housing and reservoir of FIG. 2 with the actuator assembly and piston element in uncoupled second and third orientations.
Figure 5:
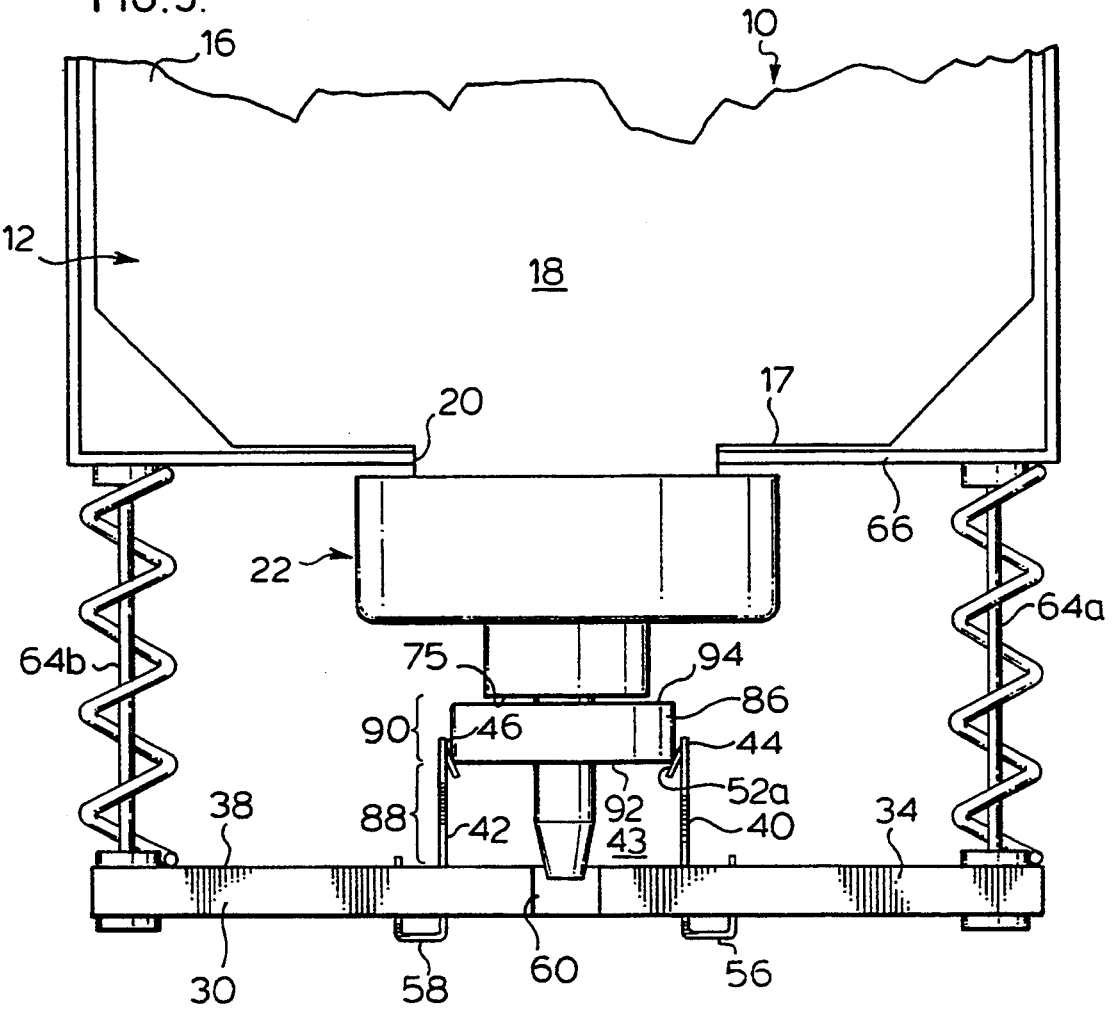

When the reservoir 12 inserted in the housing 14, the radially extending flange 86 will assume one of three orientations shown best in FIGS. 2, 4 and 5.

In a first orientation shown in FIG. 2, the catch assembly 34 and the piston element 78 are coupled to each other with the radially extending flange 86 fully in a first zone 88 (shown for clarity in FIG. 3). The first zone 88 is the area of the slot 43 delineated at an upper extent by the trailing edges **52*b*,54*b* of each respective tab 48,50 and at a lower extent by the tabular surface 38**.

In the first coupled orientation, the movement of the actuator assembly 30 moves the radially extending flange 86 therewith. As is to be appreciated the housing 14 and reservoir 12 are preferably configured so that when the actuator assembly 30 is in the first position and is coupled to the radially extending flange 86, the piston element 78 is in an optimum extended position relative to the dispensing chamber 74.

To dispense fluid 18, the actuator assembly 30 is cycled by the pivotal movement of the lever 32 moving the catch assembly 34 from the first rest position to the second retracted position shown in FIG. 3, and then the springs 72 returning the catch assembly 34 back to the first rest position. As the shoulder member 36 moves from the first rest position to the second retracted position, the tabular surface 38 engages the lower flange surface 92. As best seen in FIG. 3, the engagement of the tabular surface 38 with the lower flange surface 92, slides the piston element 78 inward in a first direction relative to the dispensing chamber 74. The piston element 78 moves inward into the dispensing chamber 74 until the upper flange surface 94 abuttingly engages the endmost surface 75, to limit further movement of both the piston element 78 and actuator assembly 30.

On release of the lever 32 the catch assembly 34 is returned to the first rest position under the force of springs **72*a*,72*b* to complete the cycle. As is to be appreciated, on return movement of the catch assembly 36 under the force of springs 72*a*,72*b*, the trailing edge 52*b*,54*b* of each tab 48,50 moves into engagement with the upper flange surface 94**, to slide the piston element 78 in a second direction outward from the dispensing chamber 74.

The reservoir 12 may also be inserted into the housing 14 with the piston element 78 in a second or third orientation. In the second orientation seen in FIG. 4, the catch assembly 34 and piston element 78 are uncoupled with the radially extending flange 86 partially in the first zone 88 and partially in a second zone 90. As best seen in FIG. 5, the second zone 90 is generally the area of the slot 43 delineated at a lower extent by the leading sides 52*a*,54*a* of each tab 48,50 and at an upper extent by the endmost surface 75 of dispensing chamber 74.

In the third orientation shown best in FIG. 5, the catch assembly 34 and piston element 78 are uncoupled with the radially extending flange 86 fully in the second zone 90.

If on sliding insertion of the reservoir 12 into the housing 14 the radially extending flange 86 assumes either the second or third uncoupled orientation, on first cycling of the actuator assembly 30, the catch assembly 34 moves relative to the flange 86 to achieve the first coupled orientation.

With the engagement flange 86 in the uncoupled orientation, either wholly or partially in the second zone 90 as shown in FIGS. 4 or 5, the initial movement of the catch assembly 34 from the first position moves the leading side 52*a*,54*a* of each of tab 48 and tab 50 into contact with the lower flange surface 92. As the fingers 40,42 move towards the web 66, the leading sides 52*a* and 54*a* act as camming surfaces, deflecting the endmost portions 44 and 46 of each associated finger 40 and 42 from the unbiased position, radially outwardly to the biased position. As is to be appreciated, the end portions 44,46 are deflected a sufficient distance to permit movement of projecting tabs 48 and 50 axially past the radially extending flange 86.

Once the tabs 48,50 move relative to the piston element 78 so that each respective trailing edge 52*b*,54*b* is positioned between the upper flange surface 94 and the chamber 16, the resiliency of the fingers 40,42 causes the return of endmost portions 44,46 to the unbiased position. On the return to the unbiased position, the trailing edges 52*b*,54*b* are moved to a position to overlap and abuttingly engage a peripheral portion of the flange surface 94. The engagement of the trailing edge 52*b*,54*b* with the flange surface 94 prevents return axial movement of the radially extending flange 86 past the projecting tabs 48,50 effectively coupling the flange 86 to the catch assembly 34 between the tabs 48,50 and the tabular surface 38.

The spacing between the tabs 48,50 and tabular surface 38, is selected to permit the insertion of the radially extending flange 86, fully within first zone 88. The tabular surface 38 and fluid passage 60 are further selected such that when the radially extending flange 86 is in the coupled orientation with the catch assembly 34, a portion of the tabular surface 38 abuts a portion of the lower flange surface 92.

The dispenser 10 of the present invention, advantageously permits insertion of the reservoir 12 into the housing without the requirement of ensuring the piston element 78 is in a particular position relative the catch assembly 30.

As is to be appreciated, with the radially extending flange 86 in the first coupled orientation, cycling of the actuator assembly 30 causes the axial inward and outward movement of the piston element 78 in the dispensing chamber 74 to dispense fluids 18. On activation of the dispenser 10, fluid 18 flows from the chamber 16 outwardly through the outermost end 80 and fluid passage 60, via the passage 82. Once the supply of fluid 18, in the chamber 16 is exhausted, the reservoir 12 may be removed for replacement by again moving the cover 24 to the open configuration shown in FIG. 1, and radially sliding the reservoir 12 outwardly in a direction transverse to the direction of axial movement in the reverse manner as insertion.

Although not essential, providing a fluid passage 60 having a U-shape and extending into a side 62 of the shoulder member 36 is advantageous as it simplifies insertion of the reservoir 12 into the housing 14. Specifically, the engagement of the outermost end 80 of the piston element 78 against the edge of the fluid passage 60 may be advantageously used to assist in guiding placement of the reservoir 12 in the correct axial alignment in the actuator assembly 30.

The preferred embodiment is shown having a two resiliently deformable ribbons of metal acting as finger members, however, the invention is not so limited. Other apparatus and modes for permitting one way coupling of the actuator assembly 30 to the piston element 78 may also be used, including but not limited to, resiliently deformable flanges or prongs adapted to engage corresponding complimentary slits formed in either of a piston element 78 or the actuator assembly.

While the preferred embodiment of the invention as shown illustrates two resiliently deformable substantially parallel finger members, the invention is not so limited. Other combinations and configurations of finger members may equally be used, and will now be apparent.

FIGS. 1 to 5 illustrate two straight locating rods 64*a*,64*b* to assist in guiding movement of the actuator assembly 30, however, the invention is not so limited. Other means of guiding movement of the actuator assembly, including curved rods to assist in guiding the shoulder member 36 in arcuate movement may also be used.

Figure 6:
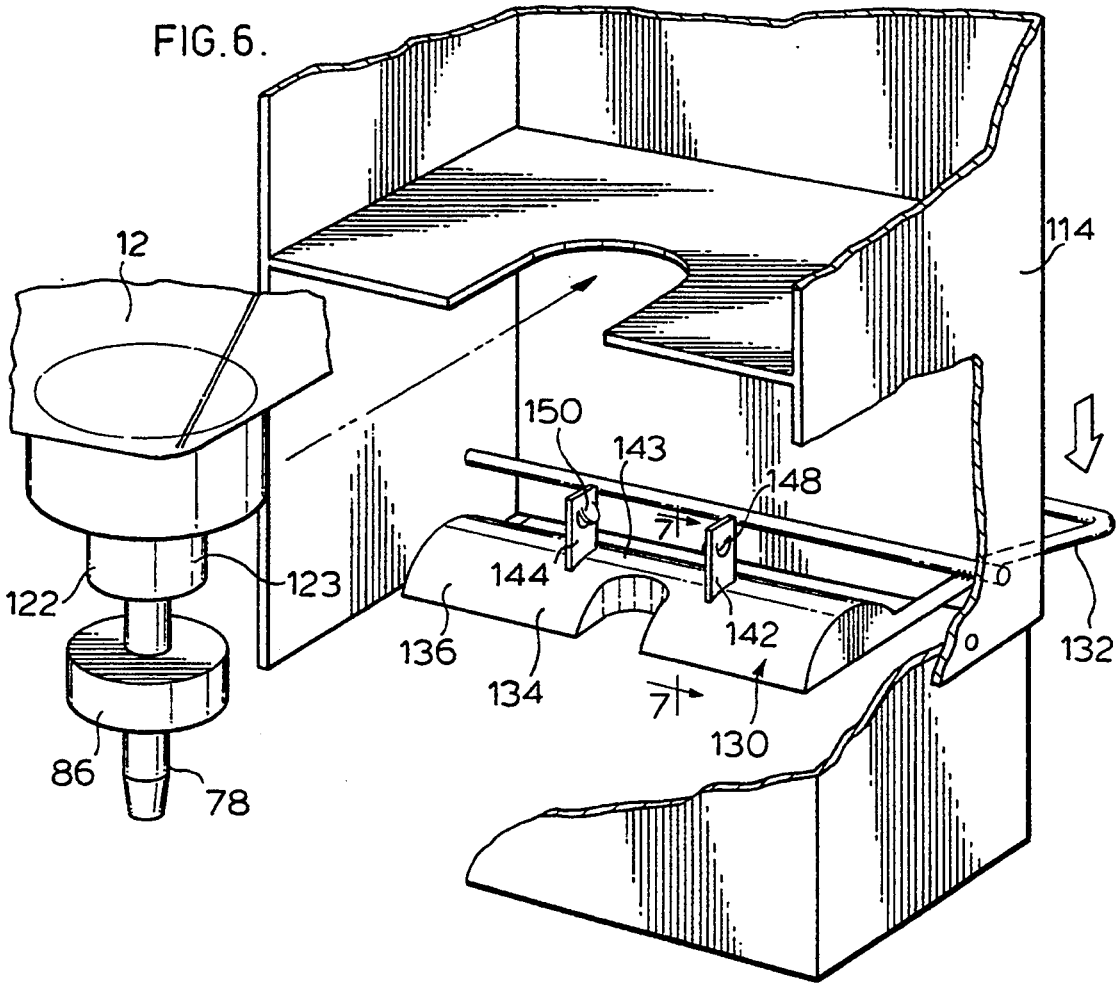
FIG. 6 is an exploded partial perspective of a housing and reservoir in accordance with a second embodiment of the invention with the housing closed for dispensing fluid.
Figure 7:
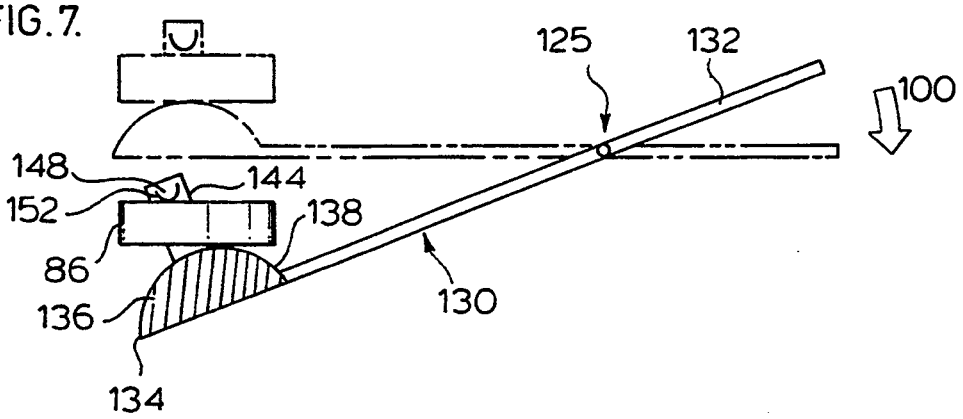
FIG. 7 is a partial cross sectional view of the piston engagement flange and the catch assembly taken along line 7—7' of FIG. 6.

Further, as shown best in FIGS. 6 and 7, the dispenser may, for example, be provided with an actuator assembly 130 characterized by a catch assembly 134 which is carried directly by and adapted for arcuate movement with a pump activating lever 132. The actuator assembly 130 shown in FIG. 7 permits insertion of a reservoir 12 either coupled or uncoupled to the catch assembly 134 in essentially the same manner as that described with reference to FIGS. 1 to 5.

FIG. 6 shows best the catch assembly 134 as being essentially the same as that shown in FIG. 1 having fingers 142,144 and a shoulder member 136, each of a similar construction to that previously described. The primary difference between the housing 114 of FIGS. 6 and 7 and that of FIGS. 1 to 5 is the elimination of locating or guide rods in the housing 114 and the provision of a shoulder member 136 having a rounded upper surface 138 and tabs 148,150 having a rounded edge 152 on each respective finger 142,144.

The flange 86 of the piston element 78 is inserted between the fingers 142,144 and assumed the coupled orientation in the manner previously described.

As shown best in FIG. 7, once in the coupled orientation, as the lever 132 is moved in the direction of the arrow 100, the rounded upper shoulder surface 138 and tab edges 152 allow for rotational contact of the catch assembly 134 with the flange 86. The rotational contact of the catch assembly 134 with the flange 86 permits substantially unhindered axial sliding of the piston element 78 as the catch assembly 134 moves along its arcuate path.

In use of a dispenser which includes a catch assembly 134 carried directly by the actuating lever 132, the catch assembly 134 is moved along an arcuate path from the first rest position to the second inserted position shown in phantom in FIG. 7, by moving the lever 132 in the direction of arrow 100. The catch assembly 134 is then returned along its arcuate path to the first position under the force of a spring.

Providing a dispenser having a catch assembly 134 which is carried by a lever 132 may be used to simplify manufacture of the dispenser. For example, by providing in the reservoir valve assembly 122, a spring 123 for biasing the piston element 78 to an extended position, the guide rods and springs of the housing may be eliminated. In one such configuration, the spring 123 may act to bias both the piston element 78 and the actuator assembly 130 to the rest position shown in FIG. 7. As is to be appreciated, the elimination of the guide rods and their associated springs advantageously reduces the number of components of the dispenser, thereby simplifying its manufacture.

Although the invention has been described with reference to preferred embodiments, it is not so limited. Many variations and modifications will now occur to persons skilled in the art. For a definition of the invention, reference may be made to the appended claims.

What I claim is:

1. A dispenser for dispensing fluid comprising, a housing, a reservoir, the housing supporting the reservoir in a dispensing position, the reservoir being insertable into said housing to assume said dispensing position and removable therefrom for replacement, the reservoir comprising, (i) a chamber for retaining fluid having an outlet, and (ii) valve means disposed across the outlet for dispensing fluid from the chamber, the valve means comprising a reciprocally movable element for reciprocal movement relative to the housing when the reservoir is in the dispensing position to dispense fluid, the reciprocally movable element including engagement means for engagement with the housing, the housing including actuator means for actuating the reciprocally movable element, the actuator means movable relative the housing between a first position and a second position, the actuator means including catch means for coupling the engagement means to the actuator means, the actuator means further having a cavity to receive the engagement means therein when the reservoir is in the dispensing position, the cavity having a first zone and a second zone, wherein on insertion of the reservoir into the housing into the dispensing position, the engagement means is located in the cavity disposed in one of:

1. a first orientation with the engagement means fully in the first zone,

2. a second orientation with the engagement means partially in the first zone and partially in the second zone, and

3. a third orientation with the engagement means fully in the second zone;

such that (a) when the engagement means is in one of the second orientation and the third orientation, on first cycling of the actuator means between the first position and the second position, the actuator means moves relative to the engagement means to assume the first orientation in which the engagement means is fully in the first zone, and (b) whenever the engagement means is in the first orientation, the catch means retains the engagement means in the first zone against movement to the second zone, thereby coupling the engagement means to the actuator means for reciprocal movement of the engagement means to dispense liquid with movement of the actuator means between the first position and the second position.

2. A dispenser as claimed in claim 1, wherein said catch means comprises tab means for contacting the engagement means when the engagement means is in said first orientation, the catch means being resiliently deformable to permit movement of the actuator means relative to the engagement means to relocate the engagement means from the second or third orientation to the first orientation.

3. A dispenser as claimed in claim 2, wherein said catch means further comprises a finger member, said tab means located in a first end portion of said finger member, which is resiliently deformable from an unbiased position where said tab means is positioned to contact the engagement means, to a biased position where said tab means is moved to a position substantially out of contact with the engagement means, when the engagement means is in the second or third orientation, on first cycling of the actuator means the reciprocally movable element engaging the first end portion of the finger member to urge the first end portion to the biased position, on movement of the engagement means to assume the first orientation, said first end portion of said finger member returning to said unbiased position.

4. A dispenser as claimed in claim 3, wherein said catch means further comprises a shoulder member cooperable with said finger member to secure said engagement means in the first orientation, wherein on movement of said actuator means from said first position to said second position said shoulder member abutting said engagement means to slide the reciprocally movable element in a first direction, and on movement of said actuator means from said second position to said first position said tab means abutting said engagement means to slide the reciprocally movable element in a second direction.

5. A dispenser as claimed in claim 4, wherein said tab means comprises an angularly projecting tab extending towards said shoulder member, said angularly projecting tab having a leading side and a trailing edge, said leading side of said angularly projecting tab defining a camming surface to assist in urging the first end portion of the finger member to the biased position, when the engagement means is in the second or third orientation, on first cycling of the actuator means the reciprocally movable element engaging the camming surface.

6. A dispenser as claimed in claim 5, wherein said angularly projecting tab is integrally formed with said finger member, and said trailing edge is configured to contact the engagement means when the engagement means is in said first orientation.

7. A dispenser as claimed in claim 6, wherein said finger member comprises a ribbon of metal.

8. A dispenser as claimed in claim 7, wherein said catch means comprises a plurality of finger members.

9. A dispenser as claimed in claim 6, wherein a second end of said finger member is secured to said shoulder member.

10. A dispenser for dispensing fluid comprising, a housing, a reservoir, the housing supporting the reservoir in a dispensing position, the reservoir being insertable into said housing to assume said dispensing position and removable therefrom for replacement, the reservoir comprising, (i) a chamber for retaining fluid having an outlet, and (ii) valve means disposed across the outlet for dispensing fluid from the chamber, the valve means comprising a reciprocally movable element for reciprocal movement relative to the housing when the reservoir is in the dispensing position to dispense fluid, the reciprocally movable element including engagement means for engagement with the housing, the housing including actuator means for actuating the reciprocally movable element, the actuator means movable relative the housing between a first position and a second position, the actuator means including catch means to engage the engagement means and couple the reciprocally movable element to the actuator means, wherein when the reservoir is inserted into the dispensing position, the engagement means and catch means assume relative positions selected from, (a) a coupled orientation in which the catch means engages the engagement means for reciprocal movement of the element to dispense fluid with movement of the actuator means between the first position and the second position, and (b) an uncoupled orientation from which on a first cycling of the actuator means between the first position and the second position, the catch means and engagement means are moved relative to each other that they assume the coupled orientation.

11. A dispenser as claimed in claim 10, wherein said catch means comprises tab means for contacting the engagement means when the engagement means is in said coupled orientation, the catch means being resiliently deformable to permit movement of the actuator means relative to the engagement means from the uncoupled orientation to the coupled orientation.

12. A dispenser as claimed in claim 11, wherein said catch means further comprises a first finger member and a second finger member, said tab means located respectively on a first end portion of each of said first and said second finger members, a first end portion of each of said first and second finger members resiliently deformable from an unbiased position where said tab means are positioned to contact the engagement means, to a biased position where said tab means are moved substantially out of contact with the engagement means, when the engagement means is in the uncoupled orientation, on first cycling of the actuator means, the reciprocally movable element engaging the first end portion of each of said first and second finger members to move the first end portion of each of said first and second finger members to the biased position, on the engagement means assuming the coupled orientation, said first end portions of each of said first and second finger members returning to said unbiased position.

13. A dispenser as claimed in claim 12, wherein said catch means further comprises a shoulder member cooperable with said first and second finger members to secure said engagement means in the coupled orientation, in said coupled orientation the movement of said actuator means from said first position to said second position causing said shoulder member to abut said engagement means to slide the reciprocally movable element in a first direction, and movement of said actuator means from said second position to said first direction causing said tab means to abut said engagement means to slide the reciprocally movable element in a second direction opposite the first direction.

14. A dispenser as claimed in claim 13, wherein the first and second finger members are spaced from each other to define a slot therebetween for receiving the engagement means when said reservoir is inserted into the dispensing position, said tab means comprising first and second angularly projecting tabs, said first and second tabs associated with said first and second finger members respectively, and extending inwardly in said slot towards said shoulder member, said first and second angularly projecting tabs each having a leading side and a trailing edge, said leading sides of said first and second angularly projecting tabs defining camming surfaces to assist in urging the first end portions of each of said first and second finger members to said biased position, when the engagement means is in the uncoupled orientation, on first cycling of the actuator means the reciprocally movable element engaging the camming surface.

15. A dispenser as claimed in claim 14, wherein said first and second angularly projecting tabs are integrally formed with said associated first and second finger members, and wherein in the coupled orientation said trailing edge of said first and second angularly projecting tabs contacting the engagement means to prevent movement of the engagement means therepast.

16. A dispenser as claimed in claim 15, wherein each of said first finger member and said second finger member comprise a ribbon of metal.

17. A dispenser as claimed in claim 16, wherein said shoulder member comprises a tabular member having a fluid passage formed therein, each of said first finger member and said second finger member being secured to the tabular member with the fluid passage therebetween, on insertion of said reservoir into said housing said reciprocally movable dispensing element axially aligning with said fluid passage, whereby reciprocal movement of said reciprocally movable element relative to the housing dispenses fluid outwardly from the chamber via said fluid passage.

18. A dispenser as claimed in claim 17, wherein said reciprocally movable element comprises a piston forming element, and the engagement means comprising a circular flange extending radially outward from about an outermost end of the piston forming element.

19. A dispenser as claimed in claim 17, wherein said housing further comprises locating means engaging the actuator means to guide movement of the actuator means between the first position and the second position, and biasing means for biasing the actuation means towards the first position, said biasing means comprising a compressed helical spring disposed about said locating means.

20. A dispenser as claimed in claim 19, wherein said fluid comprises liquid soap.

21. A dispenser as claimed in claim 11, wherein the engagement means comprises a radially outwardly extending cylindrical ring about an axis parallel a direction in which the valve means is reciprocal and having a circumferential outer surface between upper and lower axially directed shoulders, the catch means comprising two resilient deformable fingers disposed diametrically about the ring extending axially from a stop plate and biased radially inwardly into engagement with the circumferentially outer surface;

the fingers having radially inwardly directed flange means permitting the ring to slide axially selectively to the fingers from the uncoupled orientation to the coupled orientation in which one of the upper and lower axially directed shoulders engage the stop plate and the flange means engages the other of the upper and lower axially directed shoulders to prevent movement of the ring axially away from the stop plate;

the fingers and stop plate permitting the ring to slide radially for movement into and out of the dispensing position.

* * * * *